United States Patent [19]

Gehring et al.

[11] Patent Number: 4,540,028

[45] Date of Patent: Sep. 10, 1985

[54] SHUTTLELESS WEAVING MACHINE WITH GRIPPER SYSTEMS FOR THE FILLING YARN INSERTION INTO AND RETRACTION FROM THE SHED

[75] Inventors: Fritz Gehring, Lindau-Bodolz; Gerhard Hofmaier, Lindau-Oberreitnau, both of Fed. Rep. of Germany

[73] Assignee: Lindauer Dornier Gesellschaft mbH, Lindau, Fed. Rep. of Germany

[21] Appl. No.: 538,955

[22] Filed: Oct. 4, 1983

[30] Foreign Application Priority Data

Nov. 24, 1982 [DE] Fed. Rep. of Germany ..... 3243628

[51] Int. Cl.[3] ..... D03D 47/38

[52] U.S. Cl. ..... 139/453; 139/450

[58] Field of Search ..... 139/450, 453

[56] References Cited

U.S. PATENT DOCUMENTS

| | | | |
|---|---|---|---|
| 3,347,282 | 10/1967 | Kokkinis | 139/116 |
| 3,439,715 | 4/1969 | Juillard | 139/453 |
| 3,665,975 | 5/1972 | Kokkinis | 139/112 |
| 4,022,254 | 5/1977 | Volpe et al. | 139/453 |
| 4,143,684 | 3/1979 | Lindenmueller et al. | 139/450 |
| 4,259,998 | 4/1981 | Moreira | 139/453 |

FOREIGN PATENT DOCUMENTS

| | | |
|---|---|---|
| 2131302 | 12/1972 | Fed. Rep. of Germany . |
| 2130696 | 8/1973 | Fed. Rep. of Germany . |
| 3042053 | 11/1982 | Fed. Rep. of Germany . |

*Primary Examiner*—Henry S. Jaudon

*Attorney, Agent, or Firm*—W. G. Fasse; D. H. Kane, Jr.

[57] ABSTRACT

The invention relates to a shuttleless weaving machine with a reciprocating filling yarn inserting gripping member or rapier and a reciprocating pulling out gripping member or rapier forming a gripper device (1). In order to shorten the waste in filling yarn and to present a filling yarn (S1) selected by a yarn feed system in a specific position, the feed system forms a fanning-out arrangement in such a manner that each of the yarn guides (3), when in its operational position (3'), always assumes the same position. A holding device (8) for the cut-off end of the selected filling yarn (S1) is made to sufficiently yield the held yarn end, whereby the yarn end held by the holding device (8) can be retracted a distance by a controlled yarn retraction system (4, 12). The yarn retraction system (4, 12) is located between the path of the gripper device (1) and the yarn guides (3) of the feed system.

7 Claims, 6 Drawing Figures

SHED 5'
FABRIC MOVEMENT

SHUTTLELESS WEAVING MACHINE WITH GRIPPER SYSTEMS FOR THE FILLING YARN INSERTION INTO AND RETRACTION FROM THE SHED

The invention relates to a shuttleless weaving machine where the filling yarn is inserted into, and retracted from, the shed by gripper systems.

In such weaving machines, the gripper systems are provided with clamping means to seize the filling yarn or weft thread to be inserted into the shed from outside the shed and to hold it and transfer it during the insertion thereof. The next filling yarn is selected from a number of yarns by a yarn feed system which presents the selected yarn to the gripper system. To that end, a yarn feed device for the individual filling yarns, for instance of various colors and, coming from respective supply spools, is provided, for instance, with a number of needles with eyelets. These needles are raised and lowered at a predetermined rate whereby the drive of these needles is derived from the main drive of the weaving machine. In their operation, the needles move the yarn from a rest position into another position wherein it can be seized by the advancing gripper system. After beat-up and before being fed for a new filling insertion, the yarn so inserted is then cut near the edge of the fabric by scissors or a corresponding severing means. After the cut has been made, the free end of the filling yarn coming is joined to the supply spool and projects beyond the feed needle and is available for a ew filling insertion. Such a weaving machine is known, for instance, from U.S. Pat. No. 4,143,684.

If, for instance, the yarn feed device makes use of eight feed needles, there will be in practice, from the beat-up point or the interlacing point at the fabric across the scissors to the eyelets of the needles, a fan-shaped array of yarns each of which has a different length and follows a different path. Accordingly, the various fed filling yarns also are seized by the gripper system during its advance at different places and thereby the lengths of the yarn ends between the gripper and the end cut by the scissors also are of different lengths. Hence, there will be different lengths of yarn ends at the free filling end seized by the gripper system, which thereby project and due to their different length both substantially impair the appearance of the later selvage and are waste. Even though the gripper system seizing the filling yarns causes a part of the free filling yarn end to be looped-out by its clamp means, no compensation is possible and always unequally long ends remain at the pull-out side.

To reduce this waste in filling yarn, and furthermore to achieve a uniform appearance of the cut filling yarns on both the insertion and the pull-out sides of the weaving machine, German Pat. No. 3,042,053 describes a weaving machine providing a pivoting separating needle which inserts the selected filling yarn into a specified position between the members of the cutting device. This prior art also includes yarn clamp which is essentially displaceable parallel to the direction of the filling in the area of the feed device, and a holding means mounted between the cutting device and the path of the gripper system for the free end of the fed and cut filling yarn. In this known apparatus, a selected filling yarn is indeed separated from the remaining fillings and is precisely inserted into the severing device or scissors, and furthermore each filling yarn is presented by the displaceable yarn clamp in precisely the same position to the gripper system so the latter can seize it, but the displaceable yarn clamp requires a substantial construction effort and expense. Not only are the masses to be displaced a drawback, but also the path of the clamp to be displaced along the gripper guidance track is relatively long, whereby it becomes difficult to operate the weaving machine at high speeds. In the known apparatus, the yarn length between the scissors and the clamping means of the gripper system is always the same and hence it the free filling yarn end at the gripper system after cutting also remains of constant length. The free yarn end remains tensioned by the holding device so it can be seized by the gripper system. The holding device may for instance be a suction nozzle. When the gripper system seizes the filling yarn, this free filling yarn end is somewhat looped-out of the suction nozzle before the gripper system tightly seizes the yarn with its clamping means. To keep this yarn end short, it will not be at once seized by the clamping means of the gripper, but rather the yarn end, if called for, is made to loop somewhat more through the gripper before the clamping means of the gripper finally closes. Another possibility in the known weaving machine is to use an especially designed holding device. The holding device in that case consists of a controlled, mechanical yarn clamp displaceable or pivotal between two positions, that is one position is close to the cutting device or scissors and a second position close to the track of the advancing gripper system. In this case the projecting end of the filling yarn at the gripper is also of a specified length and in fact is retained even more precisely than when a suction nozzle is the holding device.

In spite of the achieved advantages, this known arrangement is not fully satisfactory. In addition to the effort and expense briefly mentioned above regarding the presenting of a selected filling yarn in specific position, the factor of different yarn characteristics manifests itself adversely. For instance, many yarns may recoil somewhat during the cutting procedure before being satisfactorily held by a suction nozzle.

Another problem is the partial looping of the yarn end in the gripper system before the clamping means of the gripper is fully effective. In this case, waste ends of different lengths may be formed. Another difficulty arises when the cut filling yarn end is held by a movable yarn clamp, above-cited, and is moved into a position close to the gripper system path. The end of the filling yarn between the movable clamp and the gripper system in theory is always of the same length, but the section of the yarn between the clamp and the gripper becomes loose due to the displacement of the clamp just as for the above suction nozzle, whereby irregularities must be expected and the yarn therefore will not be presented to the gripper for the filling insertion in a precisely specified position every time. Therefore, the desired shortening of the waste ends is not achieved.

OBJECTS OF THE INVENTION

Based on the state of the art of a shuttleless weaving machine described in German Pat. No. 3,042,053, it is the object of the present invention to avoid the mentioned drawbacks and to present the filling yarn always in a precisely determined position to the advancing gripper system without requiring special clamping means displaceable along the gripper path for this purpose. Furthermore, the filling yarn is to be fed in the tensioned state to the gripper system and the free yarn end should be guided as closely to the clamping means as possible, whereby the inevitable filling yarn waste is minimized.

SUMMARY OF THE INVENTION

According to the invention movable filling yarn presenting guide means are mounted in such a way that each yarn presenting guide needle is located in the same position when a yarn presenting guide needle is in its working position. Additionally, retraction means are located substantially between the filling yarn presenting guide means and the path of a filling yarn gripper device, for retracting the end of a selected filling yarn from a holding device for a distance. For this purpose the holding device is able to yield at least during the retraction of the filling yarn end.

BRIEF DESCRIPTION OF THE DRAWING

The invention will be further illustrated by way of example with reference to the accompanying drawings, in which.

DETAILED DESCRIPTION OF PREFERRED EXAMPLE EMBODIMENTS AND OF THE BEST MODE OF THE INVENTION

The construction of the apparatus according to the invention initially will be described generally and specifically with reference to FIG. 1., with reference to FIGS. 2 through 6 showing details of the various cooperating components.

Figure 1:
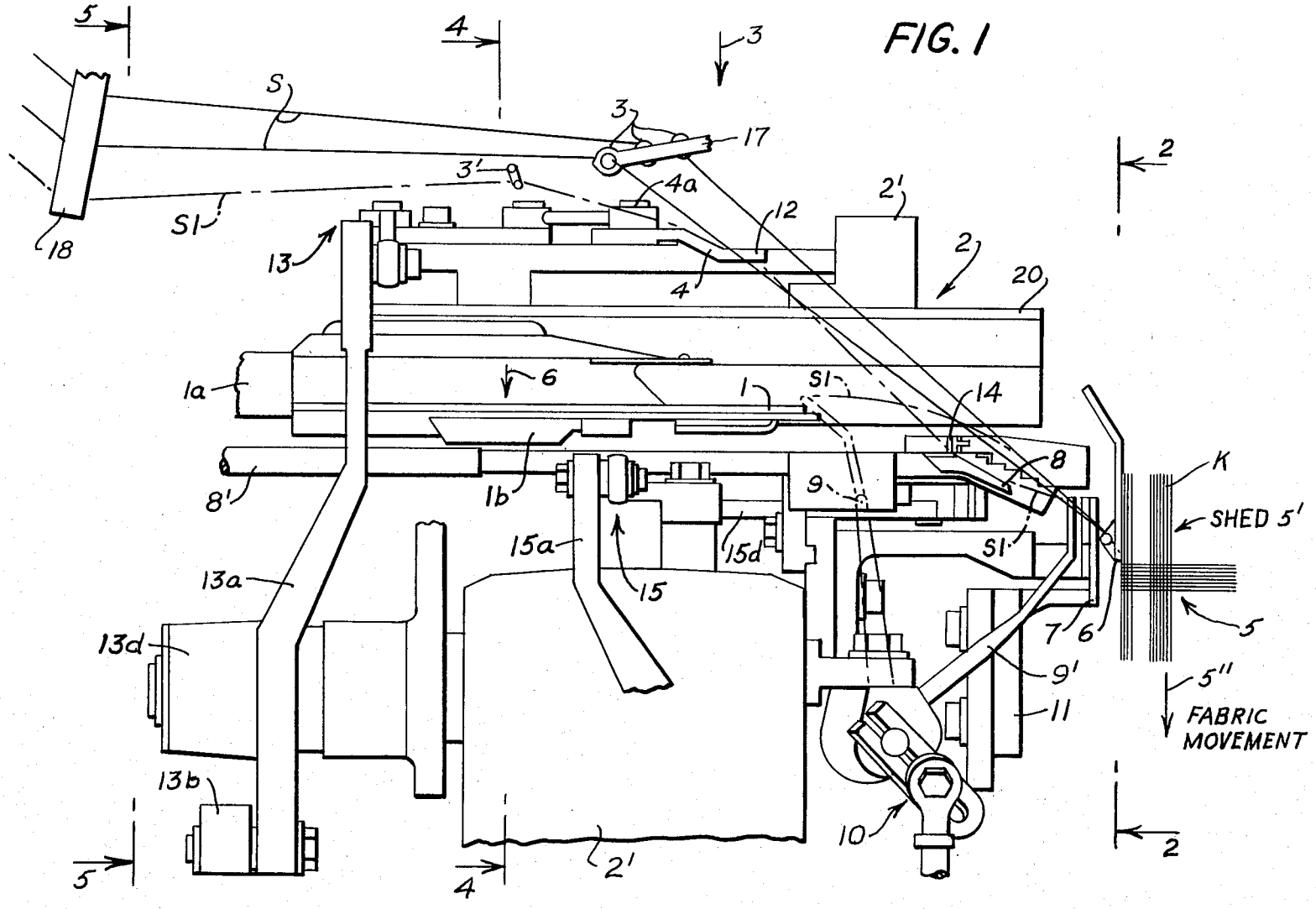
FIG. 1 is a top view of a portion of a shuttleless weaving machine which is essential for the presenting of the filling yarn and the take-up of the filling yarn by the filling yarn insertion device including part of the above-mentioned gripper system.

FIG. 1 is a top view of those parts of a weaving machine required to seize a selected filling yarn by a filling insertion device and which are mounted to the side of the fabric 5 outside of the shed 5' formed by the warp threads K. Thus, FIG. 1 shows a spatially fixed guide rail forming a guidance track 2 which is secured to the stationary machine frame 2'. The present apparatus is positioned on the filling yarn insertion side of the shed and the guide track 2 supports the advancing and retracting gripper device 1 especially during the seizing of the yarn. The gripper device 1 is advanced and retracted on that track 2 by a gripper rod 1*a* as shown in the above U.S. Pat. No. 4,143,684. The clamping means of the gripper system 1 and the control operation thereof are not described in detail inasmuch as the same is known. The figure merely indicates an actuation lever 1*b* for the clamping means of the gripper device 1. The finished fabric 5 moves in the direction of the arrow 5'' in FIG. 1 and the interlacing point 6 in indicated at the left edge of the fabric 5. A suitable scissors 7 or the cutting device for the filling yarn S, S1 is located next to the fabric edge. The filling yarns S, S1 to be inserted into the shed for connection to the fabric pass from the interlacing point 6 through the respective needles 3 of a yarn feed device and through a yarn clamp 18 to the filling yarn supply spools (not shown). In a manner known from the above-cited German Pat. No. 3,042,053, a separating needle 9 inserts in its full line operational position 9' the first filling yarn S1 shown in dash-dot lines in FIG. 1, selected for the next filling insertion, between the parts of the scissors 7 see also FIG. 2 for cutting.

Figure 2:
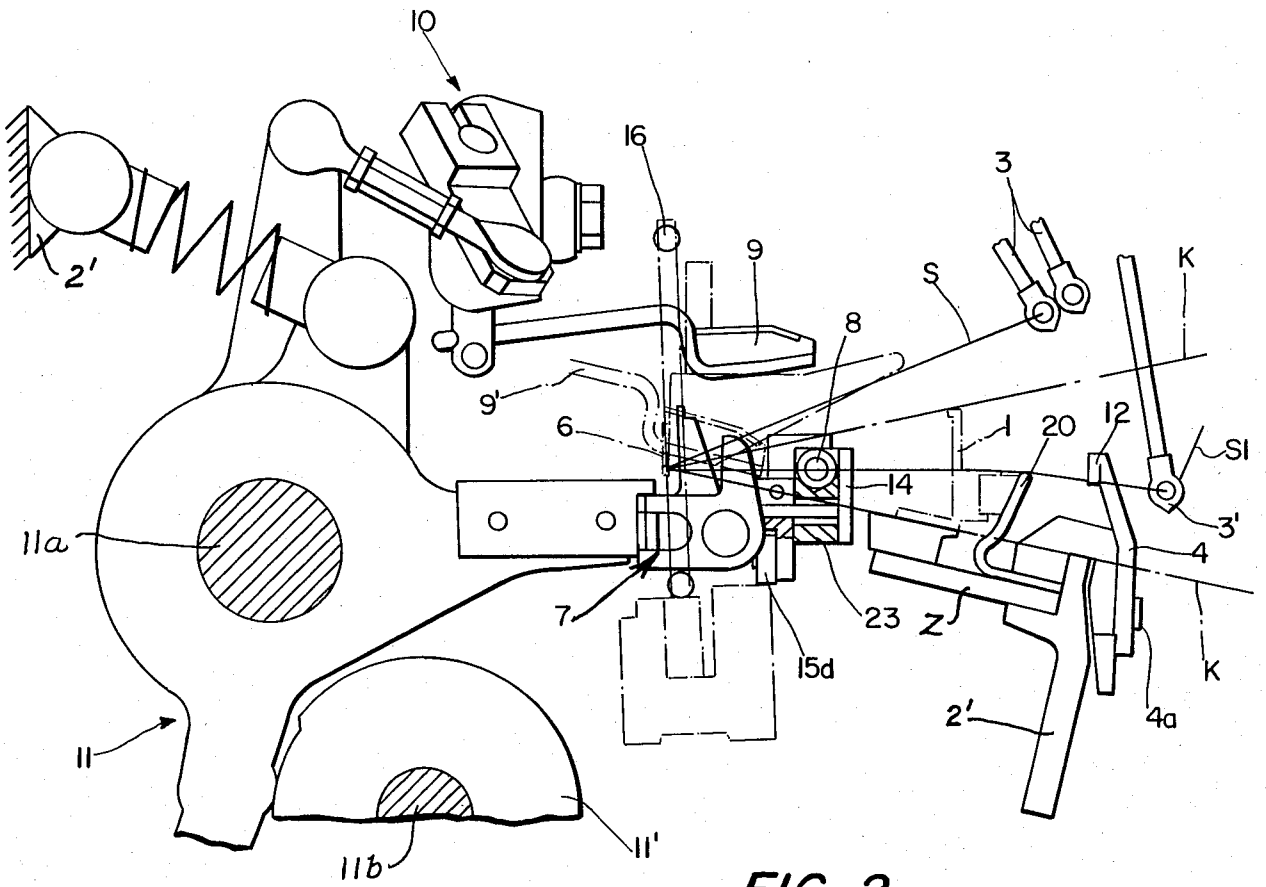
FIG. 2 is a side view taken along line 2—2 of FIG. 1.

As shown in FIG. 2, the scissors 7 are operatively mounted on a pivotable arm 11 controlled by means of an associated eccentric cam 11' acting on the arm 11 for cutting one yarn thread S1 at a time when the yarn is presented by the needle 9'. Similarly to the scissors 7, the separating needle 9 also is controlled by a crank type control device 10, shown in FIG. 2. The cam 11' through the device 10 moves the needle back and forth between the dash-dotted line position 9 and full line position 9'. The pivotable arm 11 is journalled on a shaft 11*a* and the cam 11' is rigidly secured on a rotatable drive shaft 11*b*.

Figure 3:
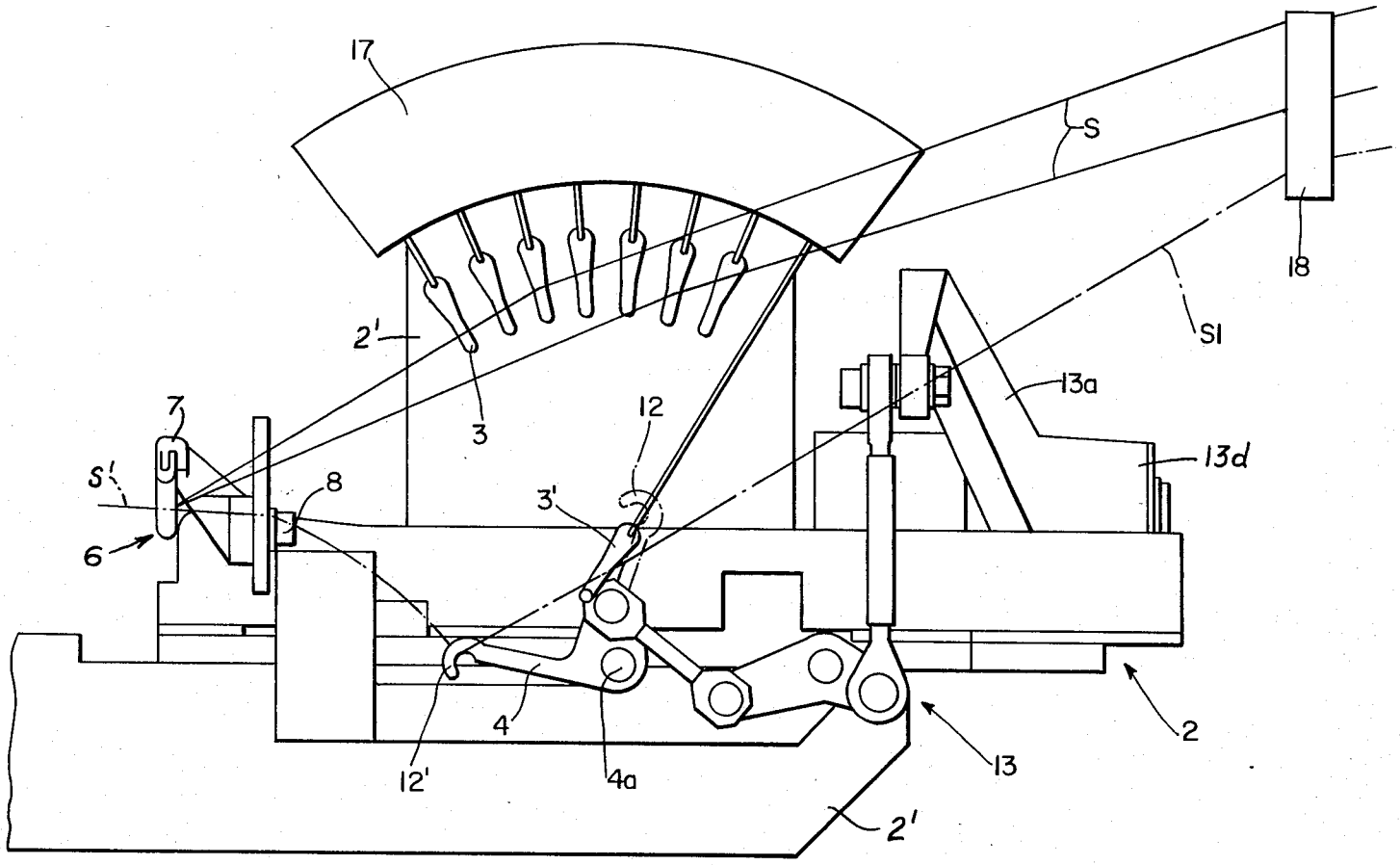
FIG. 3 is a part of the front view relating to FIG. 1, but locking substantially in the direction of the arrow 3 in FIG. 1.

The parts essential for the invention are mounted on both sides of the guidance track 2 for the advancing and retracting gripper system 1. A holding device 8 for temporarily holding the cut filling yarn end is mounted between the guidance track 2 and the scissors 7 in the position shown in FIGS. 1 and 2 for said holding of said cut yarn end. This holding device 8 becomes operative in this instance in a manner similar to that of the aforementioned German Pat. No. 3,042,053, that is by air flow, and is constructed for instance as a suction nozzle 8 whereby the air flow holds the cut end. A yarn feed device with a number of feed needles 3 is mounted on the other side of the guidance track 2 see also FIG. 3. The operational position of the needles for the selected filling yarn S1 is denoted by 3'. Furthemore, a yarn retracting device is mounted on the machine frame 2' for cooperation with the feed needles 3. As best seen in FIG. 3, the retracting device comprises in the illustrative embodiment a pivot arm 4 provided at the end thereof with the catch hook 12 and driven by a crank type drive 13 as will be described in more detail below.

As shown by FIG. 3, the feed needles 3 are so mounted within the fanned-out guidance means 17 that they present the selected filling yarn S1, shown in dash-dot lines in FIGS. 3 and 1 every time in the same operational position 3' for seizing by the gripper device 1. The filling yarn S1 is so fed through the eyelet of the feed needles 3 of the yarn guidance means 17 in its operational position 3' and over an edge 20 of the guidance track 2 the yarn S1 that it will be seized by the advancing gripper device 1, please see FIG. 2. Other arrangements of the yarn feed needles 3 are possible instead of the fanned-out arrangement as shown. The advantage of the construction and position of the needles 3 is that the particular selected filling yarns always are presented in the same position without thereby requiring a separate yarn clamp displaceable over a substantial path along the guidance track 2. The control of the yarn feed needles 3 is conventional and is not further described herein.

After the selected filling yarn has been cut, the free yarn end thereof will be held by the above-mentioned suction nozzle 8. The holding device selected for that purpose in this embodiment holds the yarn end by means of a suction air flow, similarly to the manner described in the above-cited German patent. The air suction tube 8' for the nozzle 8 sucks air through the nozzle 8. Other holding devices can be used instead of a suction nozzle 8 for instance a movable yarn clamp as described above in the German Pat. No. 3,042,053. A simple thread brake also might suffice as a holding device.

Figure 4:
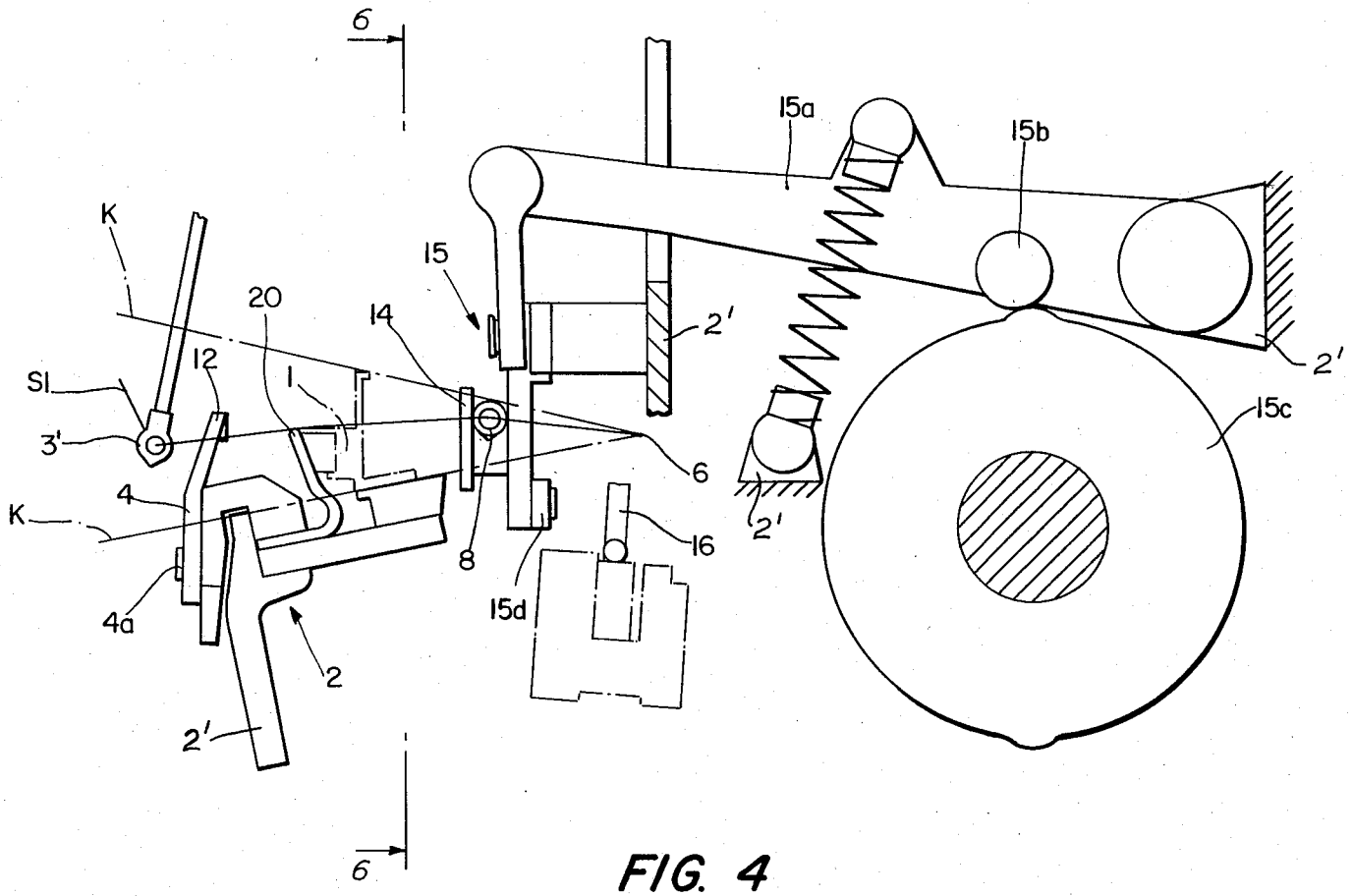
FIG. 4 is part of a cross-section taken along line 4—4 of FIG. 1.

As shown in FIGS. 3 and 4, the yarn retraction device 4, 12, 13 becomes operational before the selected filling yarn S1 is seized by the advancing gripper device 1. The pivot arm 4 of the retraction device is pivotal about a pivot bearing 4*a* mounted to the stationary guidance track 2 (FIG. 3). The pivot arm 4 supports at the end thereof a catch hook 12, shown in FIG. 3, in its rest position by dash-dotted lines.

The pivoting motion of the catch hook 12 is controlled by crank type drive 13. The operational position 12 of the catch hook 12 is shown by solid lines in FIG. 3. Due to the pivoting motion of the arm 4, the selected filling yarn S1 is drawn down over the edge 20 of the guidance track 2, whereby the filling yarn end is somewhat pulled back by the hook 12 from the yarn holding suction nozzle 8. To that end, the suction nozzle 8 functions in a somewhat yielding manner due to the air flow. However, a known yarn clamp may also function in a yielding manner. FIG. 2 shows the catch hook 12 at the beginning of the retraction movement, while FIGS. 1 and 3 show the catch hook 12 in the operational position 12′ after the termination of retraction. The retraction of the free filling yarn end always causes a taut and neat feed of the yarn end to the advancing gripper device 1; in every instance only a small yarn end projects as waste. Thereby, the waste is always of the same short length.

Where appropriate, a conventional yarn clamp 18 is provided, as shown by FIGS. 1 and 3, between the needles 3 of the yarn feed device and the omitted supply spools. This is desirable when the yarns at the interlacing point 6 tend to cling to one another when being separated by the separating needle 9. Thereby, no unwanted lengths of yarn will be drawn off of the supply spool or loose loops will be formed. The so-called yarn clamp 18 may be provided to be in common for all the filling yarns, or it can be controlled as needed for each individual yarn.

Figure 6:
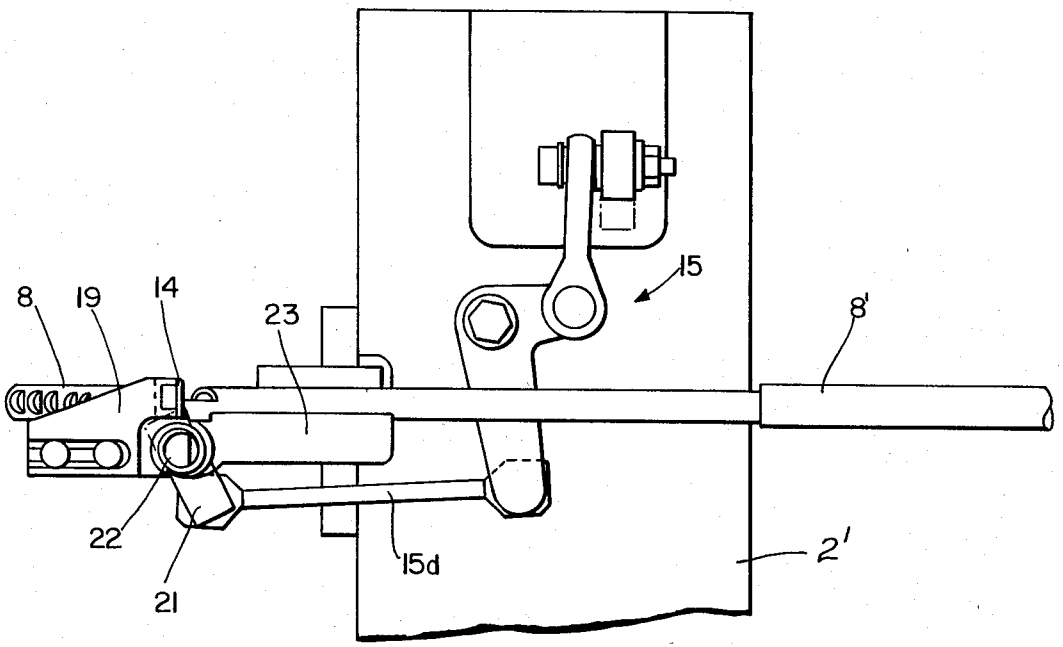
FIG. 6 is part of the elevation taken along line 6—6 of FIG. 4 and as viewed in the direction of the arrow 6 in FIG. 1.

If an airflow-operated means, for instance a suction nozzle 8 or blow nozzle is used in FIG. 1 as the holding device, then, as already mentioned above, the filling yarn S1 may somewhat recoil when being cut before being properly seized by the holding device. To prevent this, an additional yarn clamp 14 as shown in said German Pat. No. 3,042,053 is mounted between the holding nozzle 8 and the path of the advancing gripper device 1. The clamp 14 is controlled by a control drive means 15 as shown in FIG. 6. These control drive means 15 as well, just as the other controls for controlling or driving the separating needles 9, scissors 7 and yarn retraction 12, are mutually synchronized and powered, for instance, from the main drive of the weaving machine by means of excenter drives in a known manner. All of these controlled parts are light in weight and therefore are rapidly moving devices without long paths so that the weaving machine can operate at high speeds. The construction and the control of the additional yarn clamp 14 is discussed further below in relation to FIGS. 4 and 6.

Figure 5:
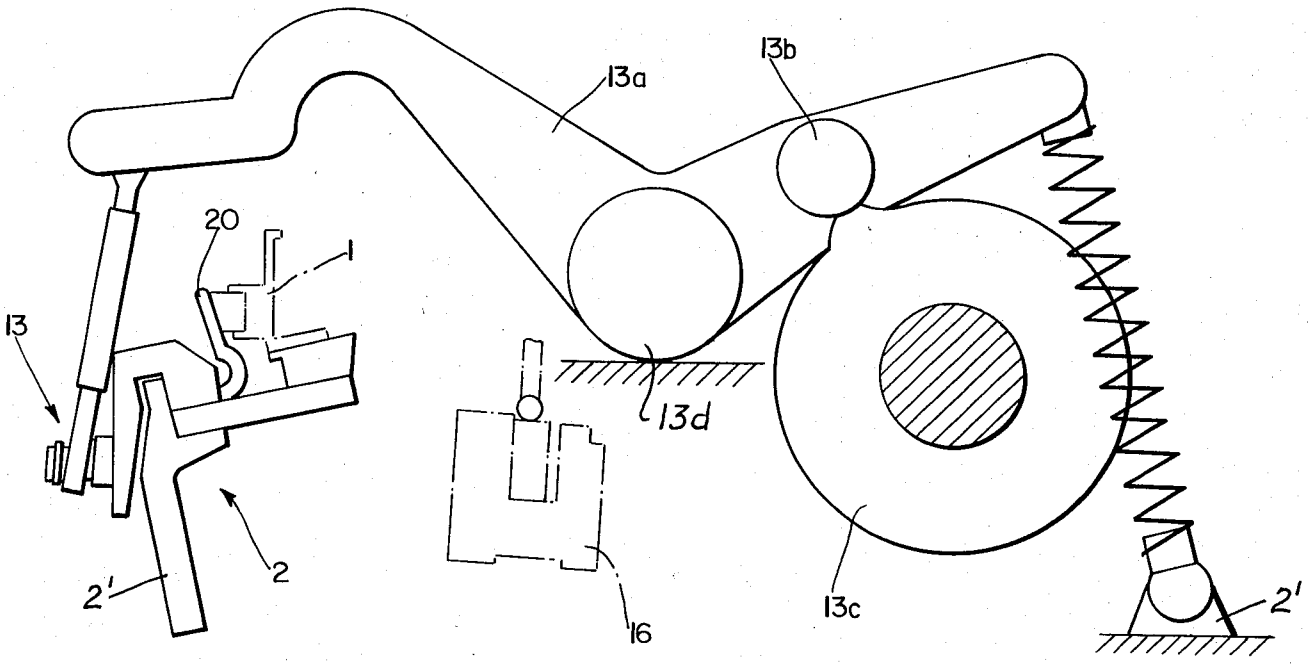
FIG. 5 is part of a side view taken perpendicularly to line 5—5 of FIG. 1.

As shown in FIG. 2, the motion of the separating needle 9 into its operational position 9′ is achieved by the crank type control drive 10. The holding nozzle 8 is positioned in the path of the selected filling yarn S1 between the path of the gripper device 1 and the scissors 7 or the interlacing point 6. The additional yarn clamp 14 is located beside the holding nozzle 8. The holding nozzle 8 is supported by a base 23. The clamp 14 is located on the side toward the gripper device 1 see FIGS. 2 and 4. A control link means 15*d* shown in FIG. 6 is provided to drive the yarn clamp 14 and will be further discussed below. FIG. 2 furthermore shows the position of the selected filling yarn S1 between the warp threads K of the shed, and also the beat-up position of the reed 16 at the interlacing point 6. FIG. 3 clearly shows the fanningout arrangement of the needless 3 held by the guide means 17. The paths of the individual guidance needles 3 all lead to the center of the fan, where one of the needles is shown in its operational position 3′. Moreover, FIG. 3 shows the motion of the yarn retraction device 4, 12, 13. The pivot arm 4 pivots about a pivot bearing 4*a* mounted on the guidance track 2. The pivot arm 4 is provided at its end with a catch hook 12 as mentioned above. The rest position of the pivot arm 4 with the catch hook 12 is shown in FIG. 3 in dash-dotted lines. The operational position 12′ is shown in solid lines. The pivoting motion of the yarn retracting arm 4 and hook 12 is actuated by the crank type drive 13. The remaining parts of the drive 13 including spring biased swing lever 13*a*, pivoted at 13*d* a sensing roller 13*b* and a control cam 13*c* are shown in FIG. 5. FIG. 3 furthermore shows the filling yarns S which are not yet selected pass from the interlacing point 6 through the eyelets of the yarn feed needles 3 to the yarn clamp 18. On the other hand, the selected filling yarn S1 extends past the holding nozzle 8 and the catch hook 12 in its position 12′ through the eyelet of the feed needle 3 in its operational position 3′ onto the yarn clamp 18.

FIGS. 4 and 6 show details of the control drive means 15 for the additional yarn clamp 14. FIG. 4 shows the arrangement of the warp threads K forming the shed 5′ and the path of the selected filling yarn S1 to the interlacing point 6. The filling yarn S1 passes over the edge 20 of the guidance track 2, through the additional yarn clamp 14 and past the holding nozzle 8 to the interlacing point 6. In that position, the filling yarn S1 can be seized by the advancing gripper system 1.

FIG. 6 shows the arrangement of the holding nozzle 8 and its air conduit 8′ held by said base 23 which itself is mounted on the machine frame 2′. The base 23 also carries a fixed support 19 for the additional yarn clamp 14. The movable clamp part of the yarn clamp 14 can be pivoted toward the fixed clamp part of the support 19. For this purpose, the movable clamp part 14 can pivot about a pivot bearing 22. The pivoting motion is controlled operating a control link 15*d* by a pivot arm 21. Individual components of the control crank type drive 15 are shown in FIGS. 1 and 4 showing a spring biased swing lever 15*a*, a sensing roller 15*b*, and a control cam 15*c* coupled to the main drive of the weaving machine.

The yarn retraction device 4, 12, 13 can be constructed in a variety of ways. Thus, in lieu of the above described catch hook 12, another lever means may be employed. However, it is also possible to use a device which becomes active by air flow. Accordingly, a blow or suction nozzle may be provided to retract the free filling yarn end in case a mechanically acting clamp means is used as the holding means between the scissors and the path of the gripper system, for instance a yarn clamp known from the aforementioned German patent, which can be pivoted into two positions. What remains essential in any event is that the yarn end is held in a yielding manner by the holding means 4, 12, 13 for the retraction operation. Such yielding holding is possible by holding nozzles, simple yarn clamps and displaceable yarn clamps.

When the filling yarns are being cut, the same length always will be set for the filling yarn ends. This length is held by the holding means when the holding means is a mechanical clamp, preventing recoil of the yarn end. In case the holding means is a nozzle or a simple thread brake, the additional yarn clamp 14, which becomes operative only during cutting, prevents this recoil. Therefore, the same cut yarn length is always assured. Furthermore, when the filling yarn end is retracted, this end is always pulled back by the retraction device by the same specified distance, so that also the length of the filling yarn end remains constant. This applies both to a mechanically acting catch hook 12 in combination with a holding nozzle 8 and to a yarn retraction means operative by airflow in combination with a displaceable yarn clamp as the holding means. In each of these cases uniformly projecting yarn ends are obtained at the gripper device i.e., at the finished fabric. Uncontrolled looping of the yarn in the clamping means of the gripper system is avoided and the retracted, and hence shortened, yarn is always seized at the same distance from its end. This distance can be kept small by correspondingly adjusting the above components, and the filling yarn waste can be reduced thereby. Lastly, it should be kept in mind that in present system combining the holding means and the retraction device, it is possible that both the holding means and the retraction device may be mechanically operative and/or operative by air-flow.

It will appreciated by those skilled in the art that modifications may be made within the scope of the present invention without departing from the spirit thereof, and the invention includes all such modifications within the scope of the appended claims.

What we claim is:

1. In a shuttleless weaving machine for weaving a fabric, including machine frame means, wherein a filling yarn is inserted by a gripper device advanced into and then retracted from a shed and including clamping means for the filling yarn, guide means (17) equipped with movable yarn guides (3) for presenting a particular selected filling yarn in a specific position to a filling yarn inserting gripping member of the gripper device, means (7) for cutting an inserted filling yarn from its associated supply spool between an interlacing point at the fabric and the path of the gripper device, a pivoting separating needle for inserting the selected filling yarn into a defined position between members of said cutting means, and a holding means (8) positioned between said cutting means and the path of the gripper device for holding the free end of the fed and cut filling yarn, the improvement comprising means (2') mounting said guide means (17) to said machine frame means so that each of said movable yarn guides in its operational position (3') is located at the same place, retraction means (4, 12, 13) operatively secured to said machine frame means and located substantially in an area between said movable yarn guides (3) and a path of said filling yarn inserting gripping member (1) of said gripper device (1) for retracting, by a distance, an end of a selected filling yarn (S1) from said holding means (8), and wherein said holding means (8) comprise yielding means for sufficiently yielding said selected filling yarn at least during a retraction by said retraction means for assuring uniformly short filling yarn ends.

2. The weaving machine according to claim 1, wherein said movable yarn guides comprises needle type yarn guide members (3) arranged in said guide means (17) in a fanningout fashion with said operational position (3') of said needle type yarn guide members being located at the center of a respective fan.

3. The weaving machine according to claim 1, wherein said clamping means include at least one controlled yarn clamp (18) adapted for intermittently holding the selected filling yarn (S1) and arranged for cooperating with said movable yarn guides.

4. The weaving machine according to claim 1, wherein said yielding holding means (8) are constructed for acting as a thread brake, said clamping means including an additional mechanical clamping means (14), drive means (15) operatively connected to said additional clamping means (14) for operating said additional clamping means during a cutting operation of said cutting means, said additional clamping means being positioned between said holding means (8) and the path of said filling yarn inserting gripping member of gripper device (1).

5. The weaving machine according to claim 4, in which said holding means (8) is operative by airflow.

6. The weaving machine according to claim 1, wherein said yarn retraction means comprise a swing arm (4) including a catch hook (12) journal means **(4*a*) operatively supporting said swing arm on a fixed guide track (2) for said gripper device (1), and drive means (13)** for positively controlling movement of said yarn retraction means.

7. The weaving machine of claim 1, further comprising separation needle means (9) operatively mounted in said machine frame for cooperation with said holding means (8), and drive means (10) operatively connected to said separation needle means for moving said separation needle means (9) back and forth between a first position close to said cutting means (7) and a second position close to said filling yarn inserting gripping member.

* * * * *